US009841159B2

(12) United States Patent
Wahl

(10) Patent No.: US 9,841,159 B2
(45) Date of Patent: Dec. 12, 2017

(54) LAMP

(71) Applicant: INTER IKEA SYSTEMS B.V., Delft (NL)

(72) Inventor: David Wahl, Stockholm (SE)

(73) Assignee: INTER IKEA SYSTEMS B.V., Delft (NL)

( * ) Notice: Subject to any disclaimer, the term of this patent is extended or adjusted under 35 U.S.C. 154(b) by 5 days.

(21) Appl. No.: 14/896,136

(22) PCT Filed: Jun. 4, 2013

(86) PCT No.: PCT/EP2013/061502
§ 371 (c)(1),
(2) Date: Dec. 4, 2015

(87) PCT Pub. No.: WO2014/194937
PCT Pub. Date: Dec. 11, 2014

(65) Prior Publication Data

US 2016/0116133 A1 Apr. 28, 2016

(51) Int. Cl.
*F21V 1/08* (2006.01)
*F21V 1/12* (2006.01)
(Continued)

(52) U.S. Cl.
CPC *F21V 1/12* (2013.01); *F21S 8/04* (2013.01); *F21S 8/06* (2013.01); *F21V 1/00* (2013.01);
(Continued)

(58) Field of Classification Search
CPC ... F21S 8/04; F21S 8/06; F21S 10/026; F21V 17/002; F21V 17/02; F21V 1/00;
(Continued)

(56) References Cited

U.S. PATENT DOCUMENTS 559,149 A * 4/1896 Stenz ..... F21V 17/02 362/322
3,598,988 A 8/1971 Link
(Continued)

FOREIGN PATENT DOCUMENTS

CN 202769351 U 3/2013
DE 20 2010 012951 1/2011
(Continued)

OTHER PUBLICATIONS

English Translation, FR 1,514,017, Mar. 13, 1967, Rosaz.*
International Search Report for International Application No. PCT/EP2013/061502 dated Feb. 28, 2014 (3 pages).
Office Action for Chinese Patent Application No. 201380077137.0, dated Jun. 2, 2017 with English translation.

*Primary Examiner* — Peggy Neils
(74) *Attorney, Agent, or Firm* — Merchant & Gould P.C.

(57) ABSTRACT

The present invention concerns a lamp (1) having a number of plates (3, 4, 5). The plates (3, 4, 5) are moveable between a position where the plates (3, 4, 5) form a common outer surface and a position where the plates (3, 4, 5) are separated from each other. By means of the plates the shape and appearance of the lamp (1) may be amended between having the form of for instance a closed sphere and a more or less open form. The plates (3, 4, 5) are placed on upper and lower curved arms (17, 26). The curved arms (17, 26) are connected to an upper ring (10) and a lower ring (9). The curved arms (17, 26) are moved by movement of the lower ring (9) towards and away from the upper ring (10).

13 Claims, 3 Drawing Sheets

(51) Int. Cl.

| | |
|---|---|
| ***F21S 8/04*** | (2006.01) |
| ***F21S 8/06*** | (2006.01) |
| ***F21V 1/00*** | (2006.01) |
| ***F21V 1/14*** | (2006.01) |
| ***F21V 3/02*** | (2006.01) |
| ***F21V 17/00*** | (2006.01) |
| ***F21V 17/02*** | (2006.01) |
| *F21W 121/00* | (2006.01) |

(52) U.S. Cl.
CPC ..... *F21V 1/146* (2013.01); *F21V 3/02* (2013.01); *F21V 17/002* (2013.01); *F21V 17/02* (2013.01); *F21W 2121/00* (2013.01)

(58) Field of Classification Search
CPC ... F21V 1/12; F21V 1/146; F21V 1/08; F21V 11/18
See application file for complete search history.

(56) References Cited

U.S. PATENT DOCUMENTS

| | | | | |
|---|---|---|---|---|
| 5,412,554 | A | 5/1995 | Lee | |
| 7,384,174 | B2 * | 6/2008 | Ejnesman | F21V 1/06 362/278 |
| 2005/0152135 | A1 | 7/2005 | Cai | |
| 2010/0171443 | A1 | 7/2010 | Zhang et al. | |
| 2013/0070949 | A1 * | 3/2013 | Fukuma | H04R 1/40 381/336 |

FOREIGN PATENT DOCUMENTS

| | | | |
|---|---|---|---|
| FR | 1514017 | * | 3/1967 |
| GB | 230 738 | | 3/1925 |
| GB | 590150 | * | 7/1947 |
| JP | 2006-032049 A | | 2/2006 |

* cited by examiner

LAMP

This application is a National Stage Application of PCT/EP2013/061502, filed 4 Jun. 2013 and which application is incorporated herein by reference. To the extent appropriate, a claim of priority is made to the above disclosed application.

TECHNICAL FIELD

The present invention concerns a lamp, especially a ceiling lamp.

BACKGROUND

The desired light pattern of a lamp may vary depending on a number of reasons. It may be that one sometimes wants a more dampened light and sometimes a more powerful light. It may also be that one wants to alter the light distribution. One way to alter the light distribution is to amend the shape of the lamp shade.

SUMMARY

An object of the present invention is to provide means making it relatively easy to alter the shape of a lamp or lamp shade.

The shape and appearance of the lamp or lamp shade of the present invention may be amended between having a relatively closed form and a more or less open form. The lamp has a number of plates, which are placed adjacent each other in the closed form. The plates may be separated from each other to reach the more or less open form indicated above. The plates could be made in any desired material. In the present example the plates are made of an opaque material, having a reflective inner surface. Thereby when the lamp has the position of being in a closed form it will only give a spread weak light. In said closed position the lamp could be said to have only a decorative function. When the lamp is opened up the light will reflect on the inner surfaces of the plates giving a light distribution depending on how much the lamp has been opened. Thus, the position of the plates may be used as a way of amending the light distribution.

The closed form may be any desired form, such as a ball shape, egg shape, pear shape, a cubic shape and also shapes having at least partially straight surfaces. The different forms are given by suitable design of the plates and arms by which the plates may be moved. Thus, even though the closed position is described below and shown in the drawings as a sphere for convenience, it is to be understood that it may have any form.

The plates are placed on curved link arms. The other ends of the link arms are received alternately on a lower ring and an upper ring. The upper ring is placed at a distance straight above the lower ring. The lower ring is arranged moveable towards and away from the upper ring.

By using several identical elements placed in different positions the costs of manufacture, storing and transport may be kept relatively low.

As used in this description the expressions "upper", "lower" and similar expressions are in relation to a ceiling lamp as pendent from a ceiling. As used in the description below the lamp has two end positions, one closed position when a sphere is formed and an open position when the plates have made a maximal movement from said closed position.

Further objects and advantages of the present invention will be obvious for a person skilled in the art reading the detailed description below.

BRIEF DESCRIPTION OF THE DRAWINGS

The invention will be described further below by way of an example and with reference to the enclosed drawings. In the drawings.

DETAILED DESCRIPTION

Figure 1:
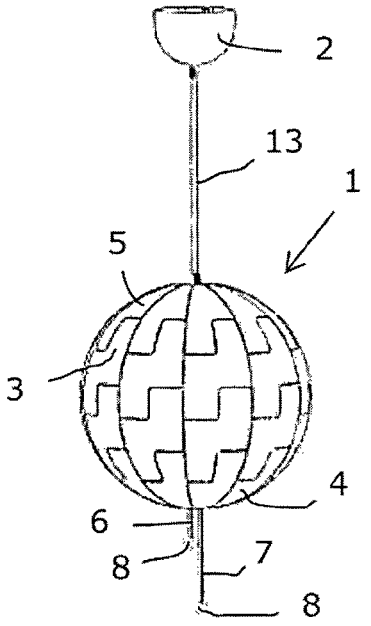
FIG. 1 is a side view of a lamp according to the present invention in a first, closed position.
Figure 2:
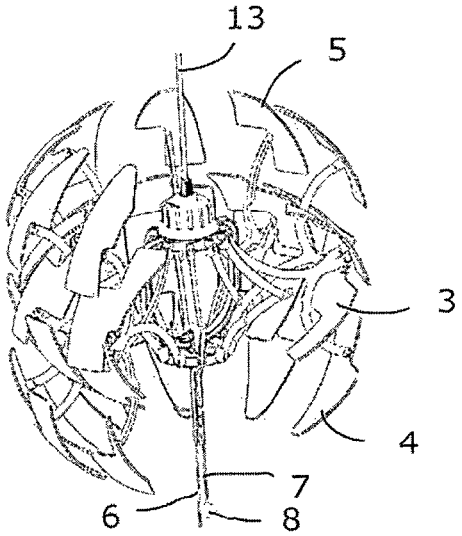
FIG. 2 is a side view of the lamp of FIG. 1 in a second, open position.
Figure 3:
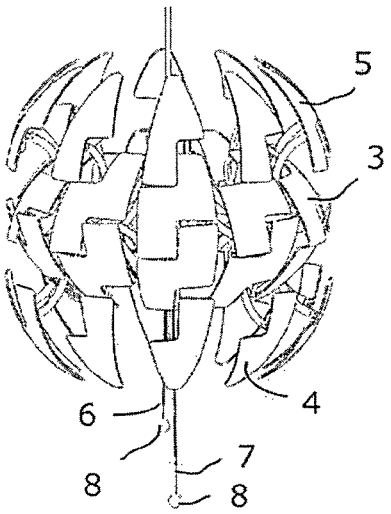
FIG. 3 is a side view of the lamp in a position between the closed and open positions of FIGS. 1 and 2, respectively.

A ceiling lamp 1 is shown with a ceiling cup 2. The ceiling lamp 1 comprises a number of plates 3, 4, 5, which plates 3, 4, 5 may be moved between two end positions. In a first end position, as shown in FIG. 1, the plates 3, 4, 5 are placed in a sphere-like form. Thus, in said first end position the plates 3, 4, 5 form a generally continuous outer surface. Expressed in another way, each plate 3, 4, 5 is placed close to or even abutting adjacent plates 3, 4, 5. In the second end position, as shown in FIG. 2, the plates 3, 4, 5 are moved away from each other, whereby each plate 3, 4, 5 is placed at a distance from the adjacent plates 3, 4, 5. The plates 3, 4, 5 may be placed in any position between the two end positions shown in FIGS. 1 and 2. Such an intermediate position is shown in FIG. 3. The light distribution of the lamp is altered depending on the position of the plates 3, 4, 5.

In the shown embodiment there are plates of two different shapes. Middle plates 3 are positioned between lower plates 4 and upper plates 5 when forming said sphere-like form. All middle plates 3 have the same shape. The lower plates 4 and upper plates 5 have the same shapes, but are placed in inverted positions in use. The plates 3, 4, 5 are normally opaque, with a reflective inner side, that is the side facing the interior of the lamp 1.

The plates 3, 4, 5 of the lamp are moved between the closed and open positions by means of a first string part 6 and a second string part 7 of a common string. The string parts 6, 7 are suspended below the lamp 1. To change the position of the plates a knob 8 at the end of one of the string parts 6, 7 is gripped and drawn downwards. The first string part 6 is drawn downwards when moving the plates 3, 4, 5 towards the open position and the second string part 7 is drawn downwards when moving the plates 3, 4, 5 towards the closed position. As it is a common string one string part will go upwards when the other string part is pulled downwards. In other embodiments two strings will be used.

The plates 3, 4, 5 are connected to a lower ring 9 and an upper ring 10, respectively, by means of link mechanisms. An intermediate band 11 is placed between the lower ring 9 and the upper ring 10, and the intermediate band 11 hangs down from the upper ring 10. The upper ring 10 is provided at a lower outer circumference of a lamp holder 12. Which lamp holder 12 is to receive a suitable light source, such as a light bulb (not shown). The lamp holder is received at the lower end of an electrical cord 13 in a normal way. The upper end of the electrical cord 13 is connected to an electrical source inside the ceiling cup 2. At the lower part of the intermediate band 11 a wheel house 14 is placed. A wheel 30 inside the wheel house 14 receives the string.

One end of upper curved arms 17 of the link mechanism are connected to the upper ring 10 in a pivot 15. The other end of each upper curved arm 17 comprises a lower curved part 18 and an upper claw-like part 20. A connection 24 at the end of the lower curved part 18 is fixed to a lower plate 4 of the lamp 1 in a rigid way. The upper claw-like part 20 has a lower claw 21 and an upper claw 22. The outer end of the lower claw 21 receives a pivot 23. The upper claw 22 has a slit 28 receiving a connection 27, by which connection 27 a middle plate 3 is fixed to the upper curved arm 17 in a rigid way. The part of each upper curved arm 17 between the pivot 15 at the upper ring 10 and the lower curved part 18 and the claw-like part 20 has a curved form.

One end of lower curved arms 26 of the link mechanisms is connected to the lower ring 9 in a pivot 16. The form of the lower arms 26 corresponds with the form of the upper arms 17, the difference being that they are turned in opposite ways. Thus, each lower arm 26 has an upper curved part 19 and an upper plate 5 of the lamp 1 is connected to the upper curved part 19 in a rigid way by means of a connection 25. Furthermore, each lower arm 26 has a claw-like part connected to middle plate 3 of the lamp 1 in a rigid fashion.

Each upper arm 17 of the link mechanism is placed adjacent a lower arm 26. The claw-like parts of the adjacent upper arm 17 and lower arm 26 are connected to each other by means of the pivot 23. Thus, the adjacent claw-like parts may turn in relation to each other.

Figure 4:
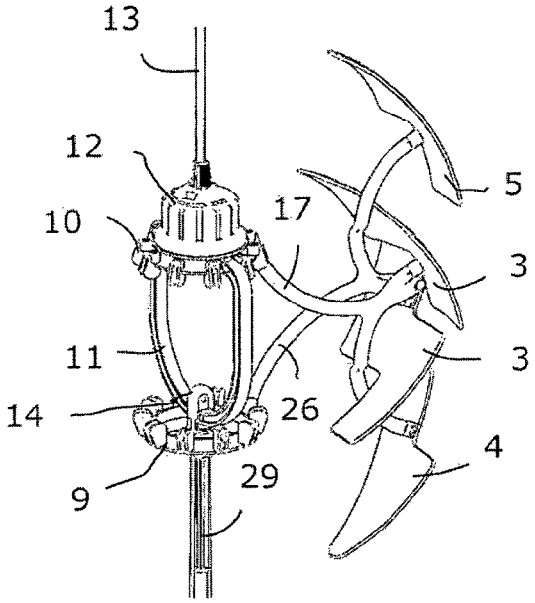
FIG. 4 is a perspective view of details of the lamp of previous Figs.
Figure 5:
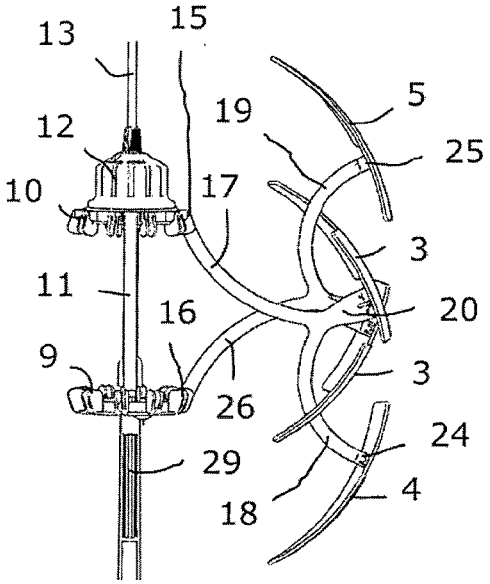
FIG. 5 is a side view corresponding to FIG. 4.
Figure 6:
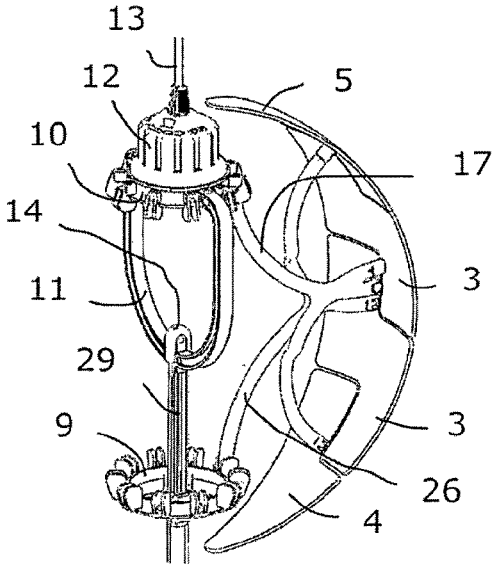
FIG. 6 is a perspective view of the details of FIG. 4 in another position.
Figure 7:
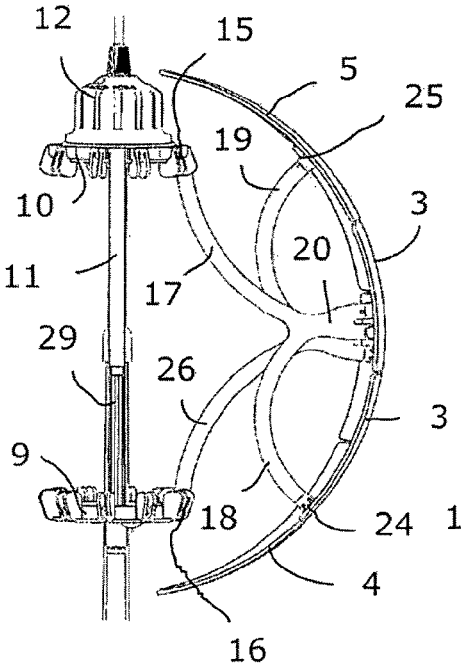
FIG. 7 is a side view corresponding to FIG. 6.
Figure 8:
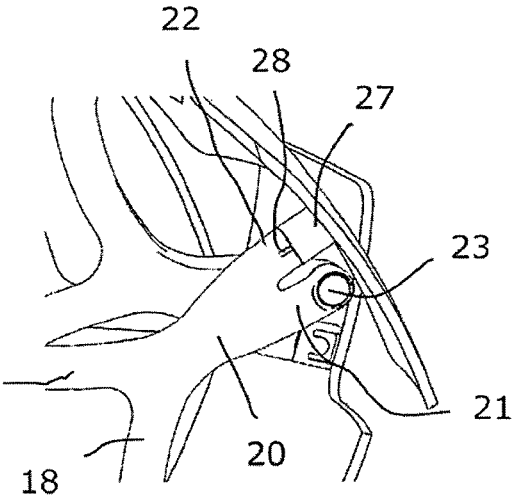
FIG. 8 is an enlarged view of a part of the details of FIGS. 4-7.
Figure 9:
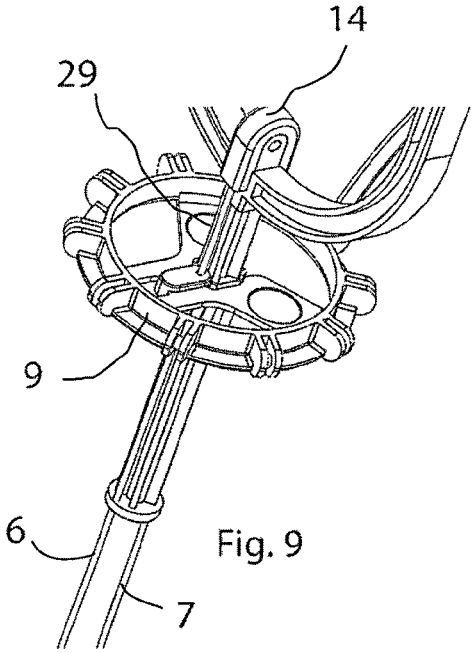
FIG. 9 is a perspective view of details of the lamp of previous Figs.
Figure 10:
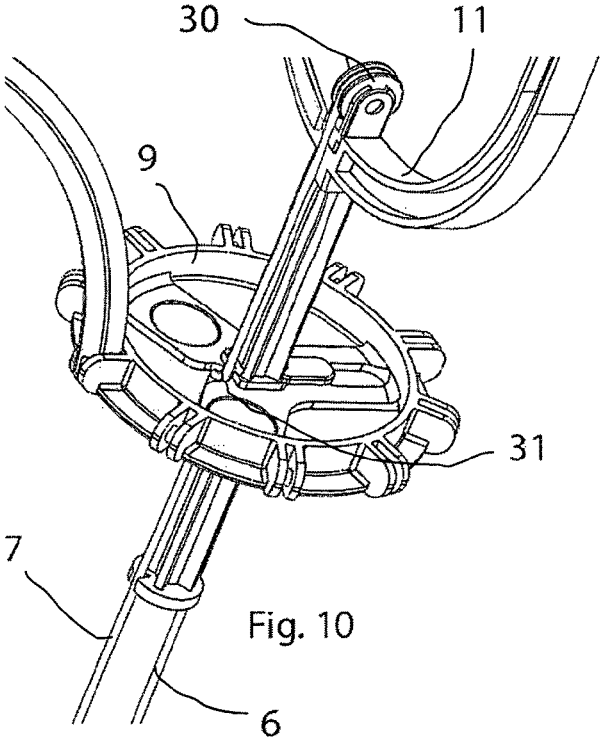
FIG. 10 is a perspective vies of details of the lamp of previous Figs.

In FIGS. 4 and 5 one upper arm 17 and an adjacent, co-operating lower arm 26 are shown in the open position of the lamp. In illustrative purpose only two co-operating upper and lower arms 17, 26 are shown, but it is understood that the other co-operating upper and lower arms 17, 26 are in corresponding positions. FIGS. 6 and 7 show the upper and lower arms of FIGS. 4 and 5 in the closed position of the lamp.

Even though the lamp is illustrated having eight pairs of co-operating upper and lower arms 17, 26, a person skilled in the art realises that any number of co-operating upper and lower arms 17, 26 may be used.

As indicated above, by amending the size and form of the plates as well as the arms of the link mechanisms, the form of the lamp in the closed position may be amended.

The lower ring 9 has a central opening receiving a rod 29. The lower ring 9 may slid up and down on the rod 29. Said central opening of the lower ring 9 and the rod 29 are given such shapes that the lower ring 9 is hindered from rotating in relation to the rod 29. The rod 29 is placed hanging down from the intermediate band 11. The length of the rod 29 should be long enough to allow the lower ring 9 to move between positions for the closed and open end positions of the plates 3, 4, 5 of the lamp 1. In the open end position of the lamp 1 the lower ring 9 has been moved upwards on the rod 29 to become adjacent to the intermediate band 11. The movement of the lower ring 9 is controlled by means of pulling the appropriate string part 6, 7. The string is placed on and turns on a wheel 30 at the lower part of the intermediate band 11. The string is placed on the wheel 30 with the string parts 6, 7 hanging down on opposite sides of the wheel 30. The first string part 6 is received in an opening of the lower ring 9 in such a way that it can move freely in relation to the lower ring 9. The second string part 7 is received in a fixation 31 on the lower ring 9, by which fixation 31 the second string part is fixed to the lower ring 9. By this arrangement the lower ring 9 will move towards the intermediate band 11 when the first string part 6 is pulled downwards. To move the lower ring 9 in a direction away from the intermediate band 11 the second string part 7 is pulled downwards.

As indicate above the common string may be replaced by two strings. Whereby a first string is fixed to the upper side of the lower ring 9 and from there goes via the wheel 30 down through an opening of the opposite side of the lower ring 9, in which opening the string can move freely in relation to the lower ring 9. The other string is fixed to the lower ring 9 in such a way that it hangs down from the lower ring 9. The wheel 30 is normally placed under a cover in form of the wheel house 14, as indicated above.

Figure 11:
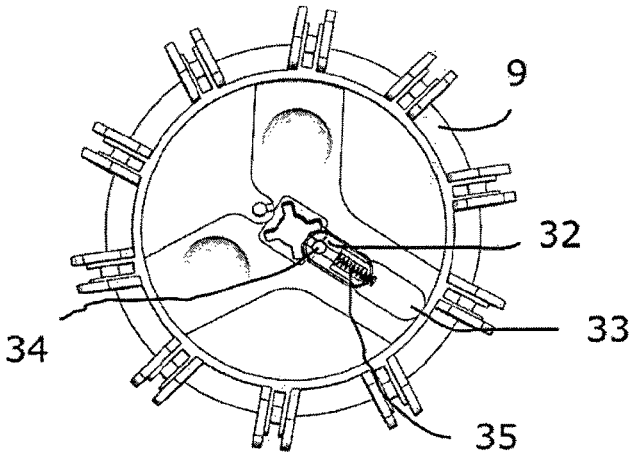
FIG. 11 is a plan view illustrating one example of a locking device.

In FIG. 11 one example of locking means is shown, which locking means is to hold the plates 3, 4, 5 of the lamp 1 in any desired position between fully closed and fully opened positions. The locking means has a slide 32 arranged slidable in a cavity 33 of the lower ring 9. The slide 32 has an opening 34 to receive one of the string parts 6. The opening 34 of the slide 32 is placed in connection with an opening of the lower ring 9 to receive the string part 6. By means of a spring 35 the slide 32 is urged outwardly, whereby the slide 32 will be pressed against the string part 6, which string part 6 thus will be locked in position by means of the slide and the openings receiving the string part 6. The spring force is strong enough to keep the string lock in any desired positions for the plates 3, 4, 5 of the lamp, at the same time as the spring force is weak enough to not hinder movement of the string part 6 when a person pulls at one of the knobs 8 at the ends of the string parts 6, 7.

A person skilled in the art realises that any type of locking device locking the plates 3, 4, 5 in a desired position may be used. The locking means do not have to act on a string part 6, 7 but could act on the lower ring 9, or one or more of the upper curved arms 17 and the lower curved arms 26.

The invention claimed is:

1. A lamp comprising:

(a) plates which form a lamp shade and are moveable between different positions;

(b) an upper ring and a lower ring, wherein the upper ring and the lower ring are arranged moveable toward and away from each other; and (c) link mechanisms comprising upper arms and lower arms, wherein each of the upper arms connects to the upper ring and receives at least one of the plates, and each of the lower arms connects to the lower ring and receives at least one of the plates.

2. The lamp of claim 1, wherein the plates are moveable between a closed position, where the plates form a common outer surface, and an open position, where the plates are separated from each other.

3. The lamp of claim 1, wherein the upper arms are upper curved arms and the lower arms are lower curved arms, and wherein each plate is received at an end of one of the upper curved arms or at an end of one of the lower curved arms.

4. The lamp of claim 3, wherein the end of each upper curved arm opposite the end receiving the plate is received in the upper ring by means of a pivot, and wherein the end of each lower curved arm opposite the end receiving the plate is received in the lower ring by means of a pivot.

5. The lamp of claim 4, wherein each curved upper arm has a lower curved part receiving a lower plate and an upper claw-like part receiving a middle plate, wherein each curved lower arm has an upper curved part receiving an upper plate and a lower claw-like part receiving a middle plate and wherein two adjacent upper curved arm and lower curved arm are connected to each other by means of a pivot at the end of the claw like part of respective upper curved arm and lower curved arm.

6. The lamp of claim 5, wherein the upper curved arms and the lower curved arms are identical, and are arranged extending from the upper ring or the lower ring in opposite directions.

7. The lamp of claim 5, wherein each plate is rigidly fixed to one of the upper curved arms or to one of the lower curved arms.

8. The lamp of claim 4, wherein the lower ring is received moveable on a rod in a direction toward and away from the upper ring, and wherein the rod is arranged hanging downwardly from an intermediate band, which intermediate band is arranged hanging downwardly from the upper ring.

9. The lamp of claim 8, wherein a first string part is received in a fixation on the upper side of the lower ring, which first string part goes from the lower ring around a wheel placed at the lower end of the intermediate band and downwardly on the opposite side of the wheel and wherein a second string part hangs downwardly from the lower ring fixed to the lower ring.

10. The lamp of claim 5, wherein all the middle plates have the same form, wherein all the upper plates and all the lower plates have the same form, and wherein the upper plates and the lower plates are placed in inverted directions.

11. The lamp of claim 9, wherein the lamp has a locking means holding the plates in a desired position.

12. The lamp of claim 11, wherein the locking means comprises a slide having an opening for receiving one of the string parts and which locking means further comprising a spring urging the slide in a direction pressing the string part against one side of the opening of the slide.

13. The lamp of claim 1, wherein the lamp is constructed to suspend from a ceiling.

* * * * *